US005389024A

United States Patent [19]

Chen

[11] Patent Number: 5,389,024

[45] Date of Patent: Feb. 14, 1995

[54] WATER SUPPLY APPARATUS FOR A DIVING SYSTEM

[76] Inventor: Wen-Shoung Chen, 7th Floor, No. 83, Li Gong Road, Tai Pin Hsiang, Taichung,

[21] Appl. No.: 162,878

[22] Filed: Dec. 8, 1993

[51] Int. Cl.[6] ..... B63C 11/02

[52] U.S. Cl. ..... 441/88; 405/186; 128/202.15

[58] Field of Search ..... 405/186; 128/202.15; 441/86, 88, 102, 106, 108

[56] References Cited

U.S. PATENT DOCUMENTS

| | | | |
|---|---|---|---|
| 183,521 | 10/1876 | Weck | 128/202.15 |
| 4,398,533 | 8/1983 | Barker | 128/202.15 |
| 4,815,893 | 3/1989 | Feder | 128/202.15 |

*Primary Examiner*—Stephen P. Avila
*Attorney, Agent, or Firm*—Bacon & Thomas

[57] ABSTRACT

A submerging equipment includes an air tank, a nozzle coupled to the air tank, a water container secured to the air tank and connected to the nozzle, a pump and a battery disposed in the water container, a switch is connected to the pump and the battery for actuating the pump, the pump is connected to the nozzle for pumping water to the nozzle and to the mouth of the diver in order to quench the thirst of the divers.

2 Claims, 5 Drawing Sheets

WATER SUPPLY APPARATUS FOR A DIVING SYSTEM

BACKGROUND OF THE INVENTION

1. Field of the Invention

The present invention relates to a submerging equipment, and more particularly to a submerging equipment having a water supplying mechanism.

2. Description of the Prior Art

Typical submerging equipments comprise an air tank for accommodating pressurized oxygen, the divers may feel thirsty after breathing three or more minutes of the oxygen, in addition, the divers may drink sea water inadvertently such that the divers may further feel thirsty.

The present invention has arisen to mitigate and/or obviate the afore-described disadvantages of the conventional submerging equipments.

SUMMARY OF THE INVENTION

The primary objective of the present invention is to provide a submerging or diving equipment which includes a water supplying mechanism for supplying water to the divers.

In accordance with one aspect of the invention, there is provided a submerging equipment comprising an air tank, a nozzle coupled to the air tank, a water container secured to the air tank and connected to the nozzle, and means for pumping water contained in the water container to the nozzle.

The pumping means includes a pump and a battery disposed in the water container, the pump being connected to the nozzle for pumping water to the nozzle, and a switch connected to the pump and the battery for actuating the pump.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
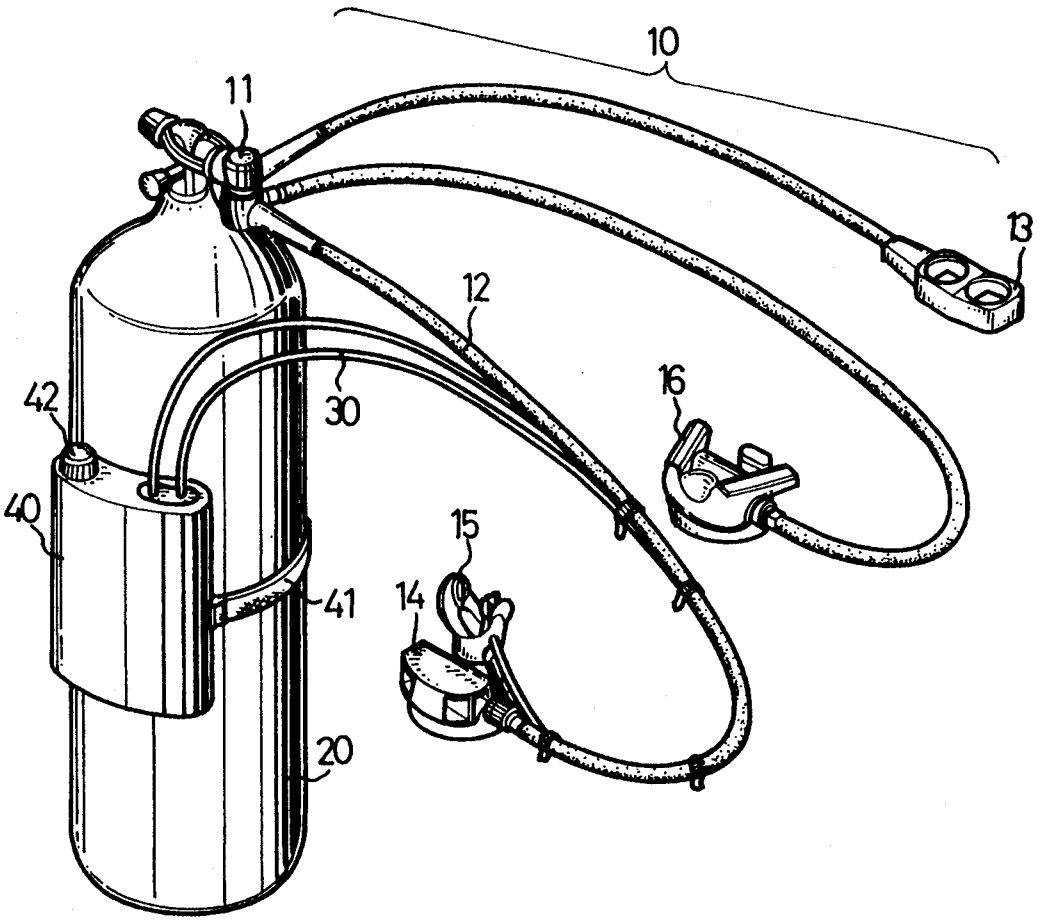
FIG. 1 is a perspective view of a submerging equipment in accordance with the present invention.

Referring to the drawings, and initially to FIG. 1, a submerging equipment in accordance with the present invention comprises an air tank 20 including a valve 11 provided in the top thereof for controlling the outlet flow of the pressurized air contained in the air tank 20, a pressure gauge 13 coupled to the valve 11 by a hose I2 for indicating the air pressure in the air tank 20, a second valve 14 coupled to the valve 11 by a hose 12 and having a nozzle 15 coupled thereto, a water container 40 secured to the air tank 20 by a fastening belt 41 and having a cap 42 provided thereon for adding water into the container 40, a pipe 30 coupled between the water container 40 and the nozzle 15, and a spare nozzle 16 coupled to the valve 11.

Figure 2:
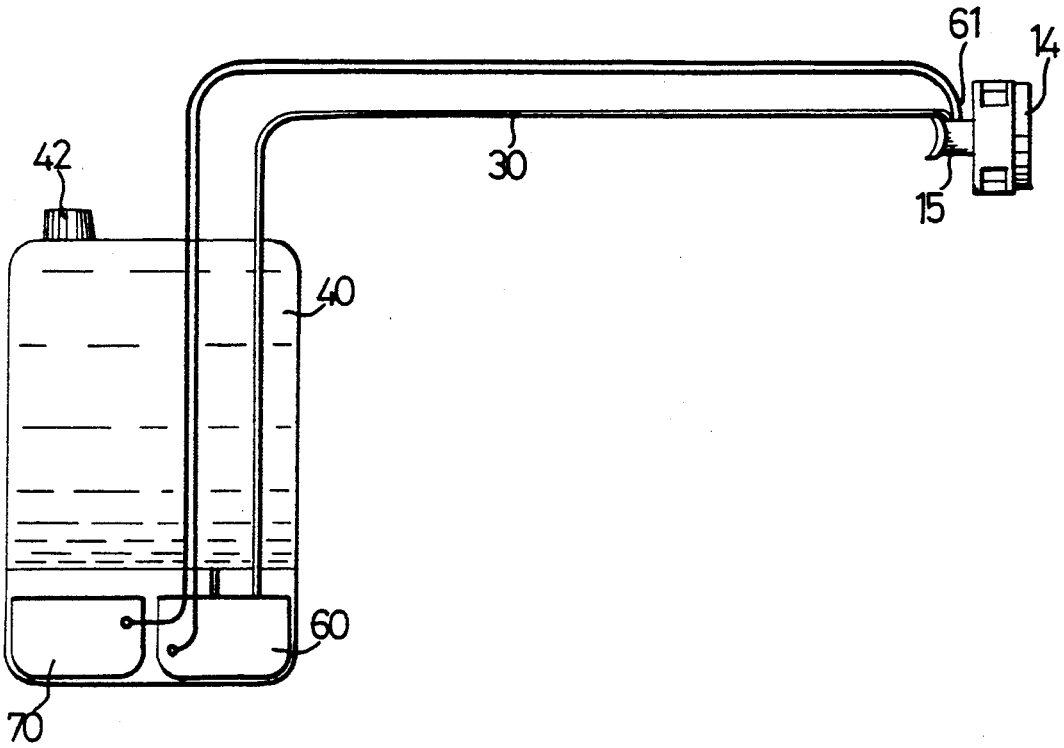
FIG. 2 is a schematic view illustrating the application of the submerging equipment.
Figure 3:
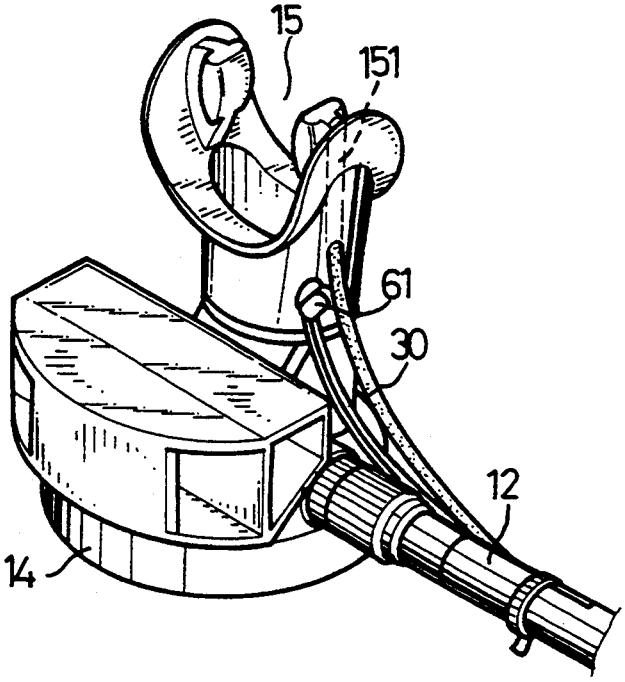
FIG. 3 is a perspective view illustrating the nozzle of the submerging equipment.
Figure 4:
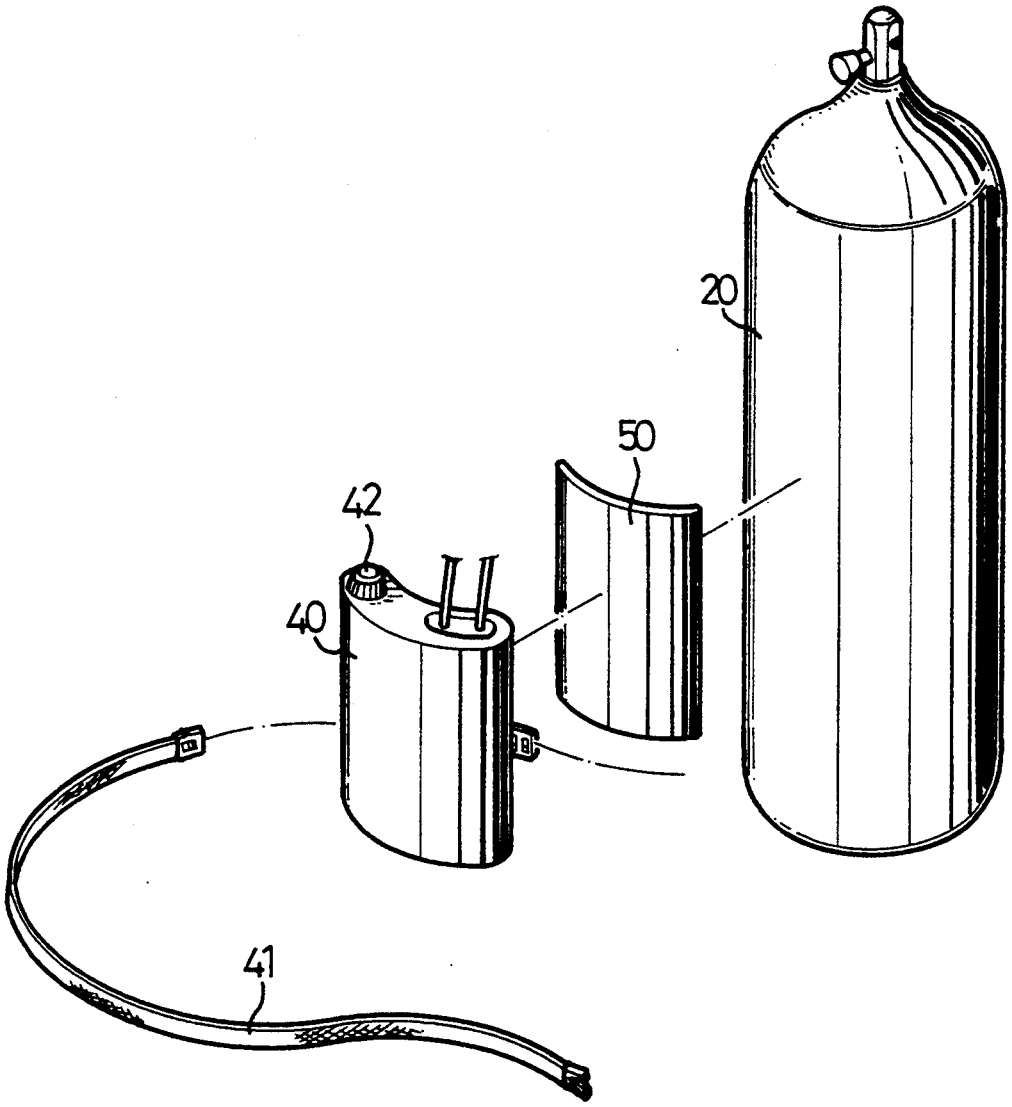
FIG. 4 is an exploded view showing the air tank and the water container.

Referring next to FIGS. 2 and 3, a pump 60 and a battery 70 are disposed in the water tank 40 for pumping water to the outlet 151 of the nozzle 15, a switch 61 is disposed on the nozzle 15 and connected to the pump 60 and the battery 70 for actuating the pump 60. Referring next to FIG. 4, it is preferable that a pad 50 be disposed between the water container 40 and the air tank 20.

Figure 5:
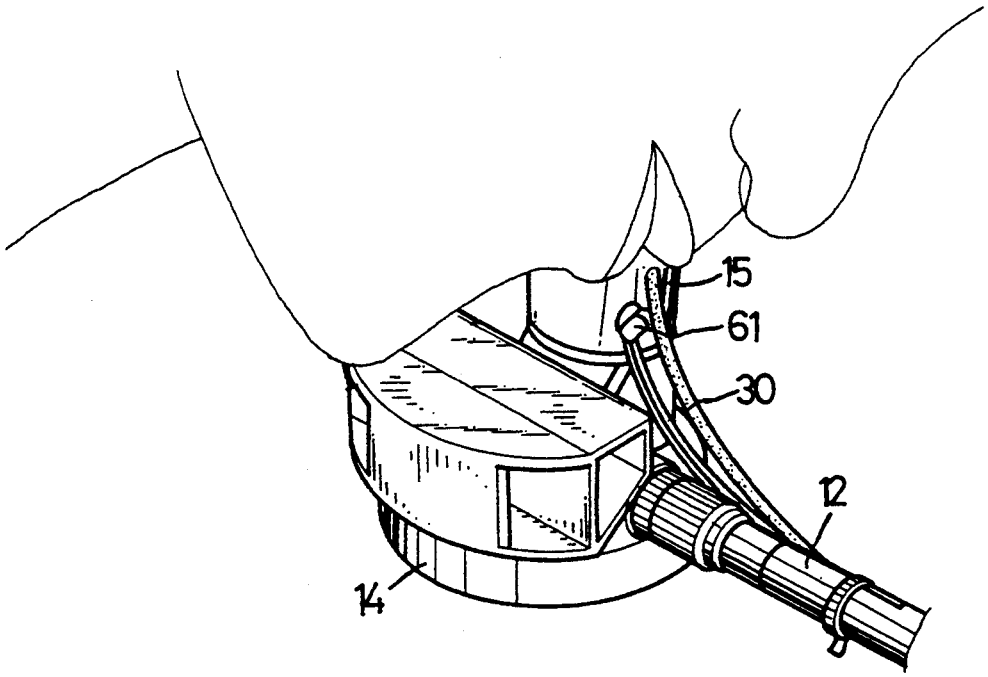
FIG. 5 is a perspective view similar to FIG. 3, illustrating the operation of the nozzle.

In operation, as shown in FIG. 5, when the nozzle 15 is engaged in the mouth of the diver, the switch 61, such as a press button can be depressed so as to actuate the pump in order to pump water into the mouth of the diver.

Figure 6:
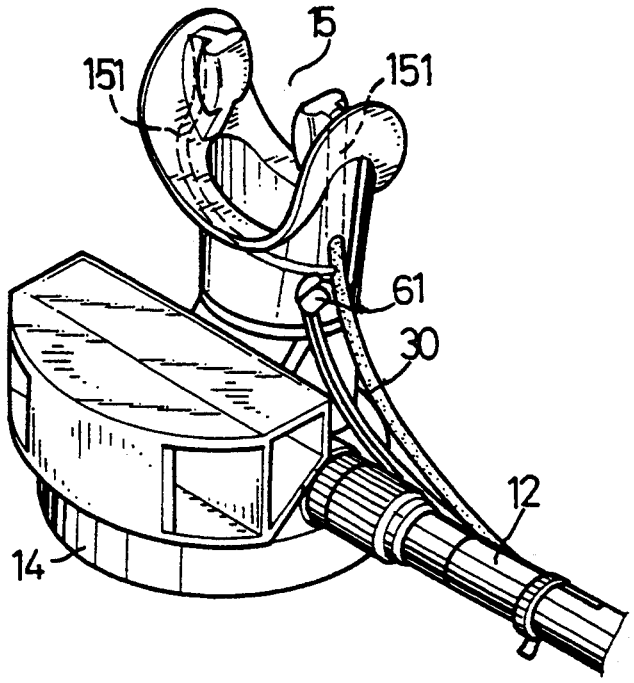
FIG. 6 is a perspective view illustrating another embodiment of the nozzle.
Figure 7:
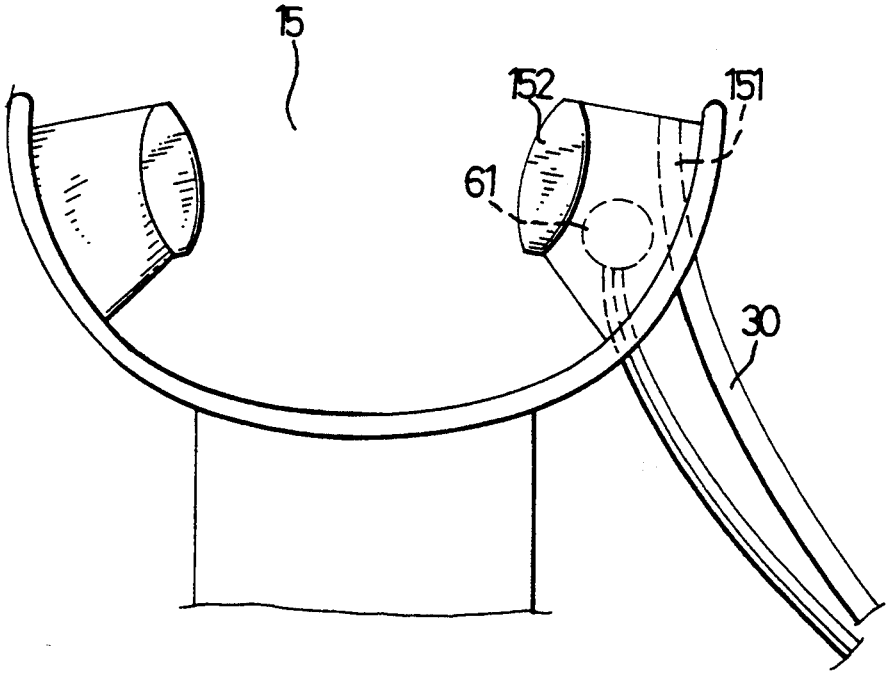
FIG. 7 is a side view illustrating still another type of the nozzle.

Referring next to FIG. 6, two outlets 151 may be provided in both sides of the nozzle 15, and as shown in FIG. 7, the switch 61' may also be provided beside the insert 152 of the nozzle 15 such that the switch 61' can be actuated by the teeth of the diver and need not be depressed by the fingers of the diver.

Accordingly, the submerging equipment in accordance with the present invention includes a water supplying mechanism for supplying water into the mouth of a diver.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A water supply apparatus for a diving system of the type including an air tank for supplying air to a nozzle engageable within the mouth of a diver, which apparatus comprises:

a) a water container for attachment to the air tank and pipe means for supplying water from the container to the nozzle, the pipe means including at least one outlet positioned for supplying water directly to the diver when the nozzle is engaged within the mouth of the diver;

b) the water container including means for pumping water from the container to the nozzle, which pumping means includes an electrically operated pump and a battery power source; and c) a switch disposed within an interior of the nozzle and in electrical connection with the pump and battery power source for actuation by the teeth of the diver to operate the pump.

2. The apparatus of claim 1 wherein the pumping means is disposed within the water constant.

* * * * *